US005725094A

United States Patent [19]

Moral

[11] Patent Number: 5,725,094

[45] Date of Patent: Mar. 10, 1998

[54] PROTECTIVE COVER FOR A STRINGED MUSICAL INSTRUMENT

[76] Inventor: Luis M. Moral, 242 S. Sycamore, Los Angeles, Calif. 90036

[21] Appl. No.: 636,226

[22] Filed: Apr. 23, 1996

[51] Int. Cl.[6] ..... A45C 11/00

[52] U.S. Cl. ..... 206/314; 24/712.5; 150/162

[58] Field of Search ..... 150/162, 163; 206/314; 84/453; D17/20; D3/204; 24/712.1, 712.5, 115 G, 115 M; 383/74

[56] References Cited

U.S. PATENT DOCUMENTS

| | | | |
|---|---|---|---|
| D. 278,442 | 4/1985 | Whomsley | 150/162 X |
| 312,804 | 2/1885 | Brown | 150/162 X |
| D. 315,167 | 3/1991 | Willis | D17/20 |
| D. 320,405 | 10/1991 | Wyant | D17/20 |
| D. 322,717 | 12/1991 | Wyant | 150/162 X |
| 2,197,977 | 4/1940 | Halpin | 150/163 |
| 3,132,390 | 5/1964 | Boden | 24/712.5 X |
| 3,877,501 | 4/1975 | Toth | 150/162 |
| 4,000,678 | 1/1977 | Messina | 84/453 |
| 4,177,847 | 12/1979 | Spindler | 150/162 |
| 4,267,868 | 5/1981 | Lowe | 383/74 X |
| 4,601,391 | 7/1986 | Gibbs et al. | 206/314 |
| 5,308,080 | 5/1994 | Lamle | 383/74 X |

FOREIGN PATENT DOCUMENTS

| | | | |
|---|---|---|---|
| 49056 | 2/1931 | Norway | 24/115 G |

*Primary Examiner*—Bryon P. Gehman
*Attorney, Agent, or Firm*—Erik M. Arnhem

[57] ABSTRACT

A protective cover for a stringed musical instrument is formed by a single fabric panel that has a peripheral edge passage for a pull cord. The cord is equipped with an adjustable clamp that can be tightened on the cord to hold the cord in a tensioned condition for stretching the fabric panel around the sound box of a musical instrument. The cover material is a stretchable elastic material that conforms to corners and irregular surface contours on the sound, so that the cover achieves a form fit on the instrument.

6 Claims, 2 Drawing Sheets

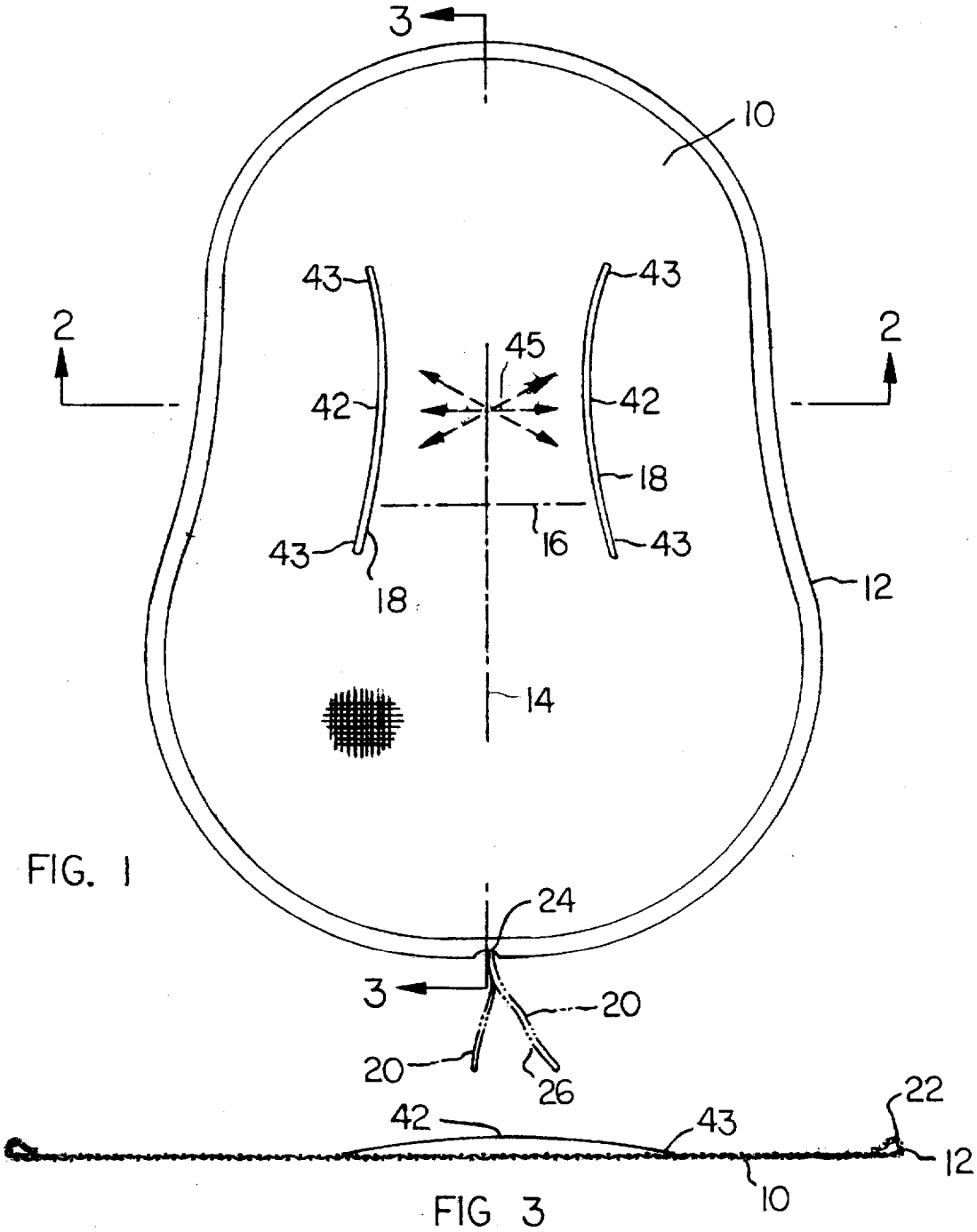
FIG. 1
FIG 3
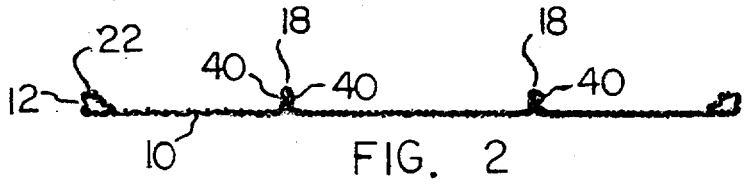
FIG. 2

PROTECTIVE COVER FOR A STRINGED MUSICAL INSTRUMENT

BACKGROUND AND SUMMARY OF THE INVENTION

This invention relates to a protective cover for a stringed musical instrument, such as a guitar, violin or cello. A principal aim of the invention is to provide a cover that can be economically produced, but that is nevertheless form-fitting on the sound box of the musical instrument. Another aim of the invention is to provide a cover that can be fitted on an instrument to leave the stringed area of the instrument fully exposed, whereby the cover can be used while the instrument is being played or is merely being stored.

Various protective covers have been devised for use on stringed musical instruments.

U.S. Pat. No. 3,251,258, issued to G. H. Parker, shows a protective cover for an electric guitar, comprising a sheet of flexible plastic material comforming to the back surface of the guitar; an auxiliary annular covering is attached to edge areas of the flexible sheet to go around the edges and across the front surface of the guitar. In one form of the invention the auxiliary annular covering is an elastic fabric having an elastic strand going along its edge to draw the fabric against the guitar body surface.

U.S. Pat. No. 3,309,954, granted to L. Phillips et al on Mar. 21, 1967, shows a cover that partially encircles a guitar, such that the cover can remain on the guitar while the guitar is being played; the cover acts as a shield to protect the guitar surface from being scratched or marred due to direct contact with the person's clothing or body. The cover is designed to extend partially across the back of the guitar and fragmentary portion of the guitar edge; a strap is adapted to encircle the mid portion of the guitar body to retain the cover in positon on the guitar.

U.S. Pat. No. 3,877,501, to John Toth, shows a protective cover for a violin. The cover is similar to the cover shown in above-mentioned U.S. Pat. No. 3,309,954, in that it is designed to protect the musical instrument while the instrument is being played. The cover comprises a semi-circular bag or sack adapted to encircle an end portion of the sound box that normally contacts the person's shoulder, neck and chin, leaving the remaining portion of the instrument uncovered.

U.S. Pat. No. 4,000,678, granted to R. Messina, discloses a flexible cover adapted to substantially cover the entire sound box of a guitar, except for the stringed area. The cover comprises two fabric panels having turned edges stitched together along approximately one half of the peripheral edge area of the cover. The remaining edge area of the cover comprises a conventional zipper tape, whereby the slider of the zipper can be opened or closed for inserting the guitar body into the cover or removing the guitar body from the cover.

U.S. Pat. No. 4,177,847, granted to Stanley Spindler, discloses a protective slip-on cover for a guitar body, comprising a back fabric sheet, a front fabric sheet, and a peripheral edge sheet joining said front and back sheets. The front sheet has a recess that exposes the strings and bridge of the instrument. The recess is of sufficient size as to permit the cover to be slipped on and off the guitar body.

U.S. Pat. No. 4,601,391, to R. Gibbs et al, discloses a ventilated fabric cover adapted to enclose the back and edge surfaces of a guitar or other stringed instrument. The cover extends onto the mariginal edge of the guitar front surface, whereby the cover is retained on the strument; an elastic band or drawstring can be provided along the marginal edge area of the cover. The cover fabric is a ventilated (open) weave material, reinforced with wear-resistant material at selected points at the edges of the instrument.

The present invention is concerned with a low cost protective cover for a stringed musical instrument, wherein the cover is formed of a single fabric panel having a shape that is roughly similar to the shape of the sound box on the instrument. The peripheral edge of the fabric panel has a cord-accommodating passage extending therealong, so that when the panel is placed against the back surface of the instrument sound box the exposed ends of the cord can be pulled to draw peripheral edge areas of the fabric onto the front surface of the sound box. A cord-clamping means can be tightened onto the cord at the point where the cord exits the peripheral passage, whereby the cord is stabilized in a tensioned condition for retaining the cover on the sound box.

The fabric panel is formed of a woven elastic material so that when the associated cord is tightened the fabric material is stretched, to thereby have a wrinkle-free form-fit on the instrument sound box. Additionally, the fabric panel can have folded pleats at selected points therealong, for generating directional tensile forces in the fabric. When the panel is installed on the sound box of the instrument, tensile forces come into play so as to promote a form fit of the fabric cover on the sound box. The fabric for the cover is preferably a soft, highly flexible woven (cloth) material that readily conforms to corners and non-linear contours on the sound box of the musical instrument.

Additional features and structural characteristics of the cover of the present invention will be apparent from the attached drawings and description of an illustrative embodiment of the invention.

THE DRAWINGS

FIG. 1 is a plan view of a fabric cover embodying the invention.

FIG. 2 is a transverse sectional view taken on line 2—2 in FIG. 1.

FIG. 3 is a longitudinal sectional view taken on line 3—3 in FIG. 1.

DESCRIPTION OF A PREFERRED EMOBODIMENT OF THE INVENTION

Figure 4:
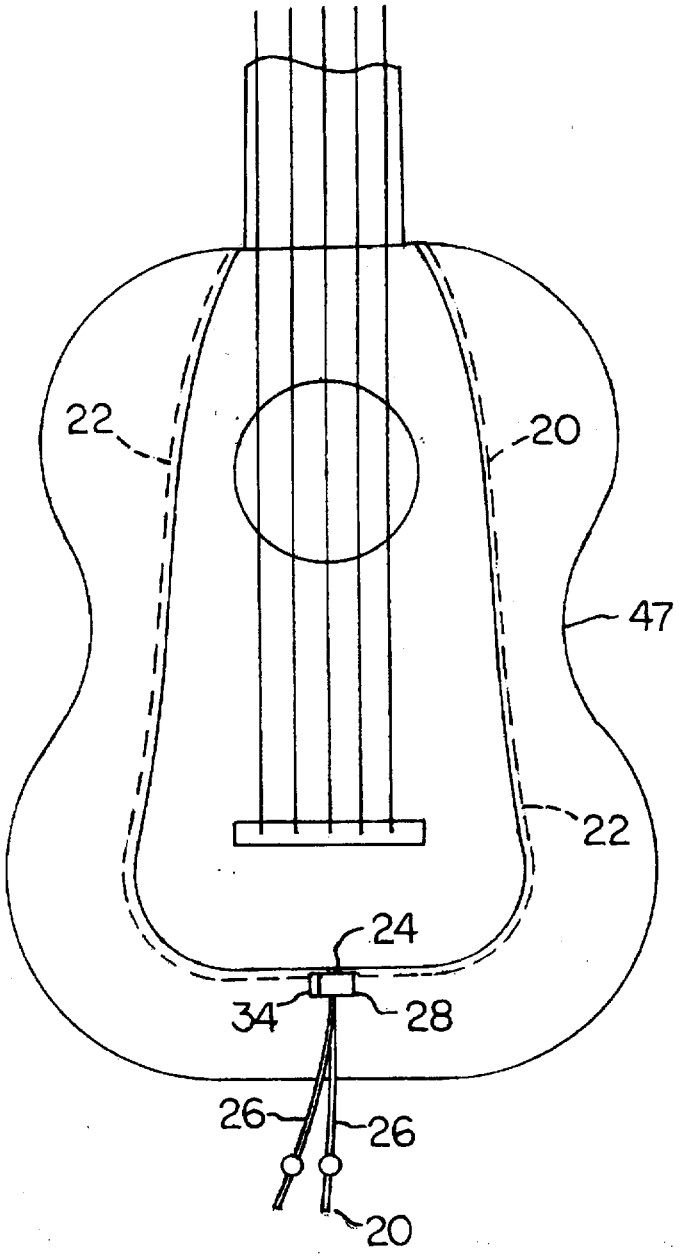
FIG. 4 shows the FIG. 1 cover installed on a guitar.

FIG. 1 shows a protective cover for a stringed musical instrument, e.g. a guitar. The cover comprises a single fabric panel 10 having a peripheral edge 12 shaped to roughly correspond to the shape of the guitar on which the cover is to be used. Fabric panel 10 has an imaginary longitudinal axis 14 and transverse axis 16. Two pleats 18 are formed in the fabric panel equidistant from longitudinal axis 14. When the fabric panel is installed on the sound box of a guitar, as shown in FIG. 4, the pleats generate tensile forces in the fabric material tending to produce a tighter fit of the fabric cover on the sound box.

An additional factor in achieving an essentially form-fit of the fabric cover on the sound box, is that the fabric is a woven material comprised of elastic threads, whereby the panel is stretchable from its normal unstressed condition (depicted in FIG. 1). A flexible cord 20 is extendable through an endless passage 22 running along the peripheral edge 12 of the fabric panel to apply a tension force to the fabric when the fabric cover is in place on the instrument sound box, such that the elastic threads of the cover stretch slightly to enable the cover to tightly conform to the surface contour of the instrument sound box. The fabric material is readily flexible so as to follow corners and non-linear contours on the sound box.

Passage 22 can be formed on panel 10 by folding the edge area of the panel back on one face of the panel, and sewing (stitching) the folded area to the panel material. FIG. 2 and 3 show the cross section of cord passage 22. The passage runs along the entire peripheral edge of the fabric panel, as shown generally in FIG. 1. A single cord access opening 24 is cut into the wall of the cord passage at a point coincident with the panel longitudinal axis 14.

A flexible cord 26 is adapted to extend through peripheral passage 22 and out through access opening 24, so that end sections 26 of the cord are exposed and accessible. The exposed sections 26 of the cord are extended through a cord-clamping device 28 that is larger than the access opening 24. The clamping device can be slidably adjusted along the cord sections 26 to assume a location proximate to opening 24.

The person can hold the clamping device 28 in a fixed position proximate to opening 24, while at the same time exerting a pulling force on the cord sections 26, such that the cord in passage 22 reduces the length of cord in the loop-like passage, thereby tensioning the fabric panel 10 on the sound box of the musical instrument. When clamping device 28 is released it automatically exerts a clamping force on the exposed sections of the cord so as to retain the tension on fabric panel 10.

Figure 5:
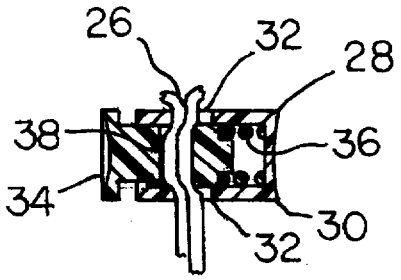
FIG. 5 is an enlarged sectional view taken through a cord-clamping means used in the FIG. 4 cover.

As shown in FIG. 5, clamping device 28 comprises a tubular housing 30 having two aligned circular holes 32 in its tubular side wall. A cooperating plunger 34 is slidable in the tubular housing against the biasing force of a coil spring 36. The plunger has a transverse circular hole 38 that is alignable with holes 32 in the housing side wall.

Clamping device 28 can be held between the thumb and first finger of the person's hand, such that a squeezing force is exerted on the end surfaces of housing 30 and plunger 34, to align hole 38 with the two holes 32. The exposed sections 26 of cord 20 can be extended through the aligned holes. When manual squeeze pressure on the end surfaces of housing 30 and plunger 34 is released, the spring 36 moves the plunger outwardly (leftwardly) in housing 30, thereby causing the cord sections to be clamped against slidable motion. FIG. 5 shows the clamping device in its clamped condition, wherein cord sections 26 are locked against slidable movement through holes 32 and 38.

When a person applies a squeezing force on the end surfaces of plunger 34 and housing 30, the hole 32 becomes aligned with holes 32, such that cord sections 26 can be pulled through the aligned holes. When the squeezing force on the ends of plunger 34 and housing 30 is released, the clamping device automatically exerts a clamp action on cord sections 26, to prevent relative movement between the cord sections and the clamp device.

Clamping device 28 is normally positioned on the cord sections 26 at a point proximate to cord access opening 24 in cord passage 22 (as shown in FIG. 4). The person can exert a squeeze pressure on clamping device 28 with one hand, while exerting a pulling force on the exposed cord sections 26 with his other hand. This action reduces the length of the cord within passage 22, thereby drawing peripheral edge areas of fabric panel 10 toward the geometric center of the sound box of the stringed musical instrument.

The fabric cover is preferably in a partially tightened condition when it is initially placed around the instrument (by partially pulling the cord 20 out of passage 22). After the cover is loosely positioned on the instrument sound box, cord 20 is pulled and clamped to achieve final positionment of the cover.

FIG. 4 shows the fabric cover in its final installed position on the guitar sound box, with clamping device 28 located against the cord access opening 24 to clamp the cord 20 in a tensioned condition, whereby peripheral edge areas of fabric panel 10 lie tight against the front face of the guitar sound box. The fabric panel covers the entire back surface of the sound box and peripheral areas of the box front surface. As previously noted, the protective cover comprises a single fabric panel formed of a woven fabric material, wherein the fabric threads are elastic. The fabric panel is thus stretchable to have a wrinkle-free, form-fit on the instrument sound box when the cord is pulled and then clamped by the clamping device 28.

Cord 20 is flexible. It can be elastic or non-elastic, without necessarily affecting the fit of panel 10 on the instrument sound box. The fabric cover is designed to partially overlie the front surface of the sound box, such that the instrument can be played with the cover in place on the sound box, at the option of the musician. The fabric cover protects the surface of the sound box against scratching or disfigurement by external forces.

As shown in FIGS. 1 through 3, the fabric panel is formed with two arcuate pleats 18 extending generally parallel to the panel longitudinal axis 14. Each pleat comprises a localized folded fabric area that provides two upstanding fold walls 40 (FIG. 2) projecting from one face of the panel. Walls 40 are stitched together along the joint line with the fabric panel.

Each arcuate pleat 18 comprises a central portion 42 located relatively close to longitudinal axis 14, and two end portions 43 located relatively far away from axis 14, in accordance with the arcuate nature of the pleat in the plan dimension. As shown in FIG. 3, the representative pleat has a relatively great fold height at each end portion 43.

The constructions and locations of the arcuate pleats 18 are such that when cord 20 is operated to tension the fabric panel on the instrument sound box the pleats generate tensile forces in the fabric, as indicated by arrows 45 in FIG. 1. The tensile forces are generally in a transverse direction paralleling transverse axis 16, so as to tighten the fabric on the central waist area 47 of the sound box (FIG. 4).

The pleat fold walls 40 tend to draw the fabric threads toward the central point defined by arrows 45, so that when the fabric material is tightened on the sound box the fabric tends to cling more tightly to the waist area 47 of the sound box, which represents the sound box area that is most difficult to fit. The cover will be positioned on the sound box so that pleats 18 are on the inside surface of the fabric panel, i.e. the surface lying against the sound box.

The drawings show a protective cover designed to fit on the sound box of a guitar. The invention can be used with stringed musical shapes of different configurations and sizes, e.g. violins and cellos. Openings can be formed in the fabric panel to accommodate protuberances found on different instruments, e.g. the chin rest on a violin.

The drawings show particular features and constructions useful in practice of the invention. However, it will be appreciated that the invention can be practiced in various forms and configurations.

What is claimed is:

1. A protective cover for a stringed musical instrument, wherein the instrument has front and back surface; said cover comprising:

a single fabric panel having a peripheral edge, and a cord-accommodation passage extending along said peripheral edge; said passage having a single cord access opening therein;

said fabric panel being a woven fabric material comprised of elastic threads, whereby said panel is stretchable from its normal unstressed condition;

a flexible cord extending within said passage, said cord having end sections thereof extending through said access opening;

a cord-clamping means movable along the end sections of said cord;

said fabric panel being adapted for placement against the back surface of a stringed instrument sound box so that edge areas of the fabric panel are in facial engagement with the box front surface;

said cord end sections being manually movable, while said cord-clamping means is held in a position proximate to the cord access opening; whereby the cord is tensioned to stretch the fabric panel against the sound box front and back surfaces;

said fabric panel having two parallel pleats spaced from the peripheral edge of the panel to lie against the back surface of the sound box when the panel is installed on the box; said pleats being operable to generate a tensile force in the fabric normal to the direction taken by the pleats.

2. A protective cover for a stringed musical instrument, wherein the instrument has front and back surface; said cover comprising:

a single fabric panel having a peripheral edge, and a cord-accommodation passage extending along said peripheral edge; said passage having a single cord access opening therein;

said fabric panel being a woven fabric material comprised of elastic threads, whereby said panel is stretchable from its normal unstressed condition;

a flexible cord extending within said passage, said cord having end sections thereof extending through said access opening;

a cord-clamping means movable along the end sections of said cord;

said fabric panel being adapted for placement against the back surface of a stringed instrument sound box so that edge areas of the fabric panel are in facial engagement with the box front surface;

said cord end sections being manually movable, while said cord-clamping means is held in a position proximate to the cord access opening; whereby the cord is tensioned to stretch the fabric panel against the sound box front and back surfaces;

said fabric panel having a longitudinal axis and a transverse axis;

said panel containing two pleats extending parallel to said longitudinal axis, said pleats being equidistant from the longitudinal axis of the panel to generate tensile forces in the panel generally parallel to the panel transverse axis.

3. The protective cover of claim 2, wherein said cord access opening is located on the longitudinal axis of said fabric panel.

4. The protective cover of claim 2 wherein said pleats are of arcuate plan configuration; each pleat comprising a central portion located relatively close to the panel longitudinal axis, and two end portions located relatively far away from the panel longitudinal axis.

5. The protective cover of claim 4, wherein each pleat comprises a folded fabric area that forms two fold walls projecting from the fabric panel.

6. The protective cover of claim 5, wherein each pleat has a relatively great fold height at the central portion of the pleat, and a relatively small fold height at each end portion of the pleat.

* * * * *